US005164047A

United States Patent [19]

Koski

[11] Patent Number: 5,164,047

[45] Date of Patent: Nov. 17, 1992

[54] HOT-PRESSING METHOD

[75] Inventor: Erkki Koski, Jyväskylä , Finland

[73] Assignee: Valmet Paper Machinery Inc., Finland

[21] Appl. No.: 640,870

[22] Filed: Jan. 14, 1991

Related U.S. Application Data

[62] Division of Ser. No. 495,484, Mar. 19, 1990, Pat. No. 5,092,962.

[30] Foreign Application Priority Data

Mar. 30, 1989 [FI] Finland ..... 891531

[51] Int. Cl.[5] ..... D21F 3/00

[52] U.S. Cl. ..... 162/206; 162/358.5

[58] Field of Search ..... 162/206, 215, 358, 359, 162/360.1, 361; 100/153, 154, 93 RP; 34/111, 116

[56] References Cited

U.S. PATENT DOCUMENTS

| | | | |
|---|---|---|---|
| 3,198,696 | 8/1965 | Justus | 162/360.1 |
| 3,783,097 | 1/1974 | Justus et al. | 162/360.1 |
| 3,808,092 | 4/1974 | Busker | 162/205 |
| 3,840,429 | 10/1974 | Busker et al. | 162/358 |
| 3,970,515 | 7/1976 | Busker | 162/360.1 |
| 4,110,156 | 8/1978 | Stotz et al. | 162/360.1 |
| 4,139,410 | 2/1979 | Tapio et al. | 162/360.1 |
| 4,201,624 | 5/1980 | Mohr et al. | 162/305 |
| 4,229,253 | 10/1980 | Cronin | 162/361 |
| 4,257,844 | 3/1981 | Schmitt et al. | 162/360.1 |
| 4,324,613 | 4/1982 | Wahren | 162/206 |
| 4,492,611 | 1/1985 | Meinander | 162/358 |
| 4,738,752 | 4/1988 | Busker et al. | 162/359 |
| 4,790,908 | 12/1988 | Roerig et al. | 162/358 |
| 4,948,466 | 8/1990 | Taakkola | 162/360.1 |
| 4,976,820 | 12/1990 | Lacpotti | 162/206 |

FOREIGN PATENT DOCUMENTS

| | | | |
|---|---|---|---|
| 1020383 | 11/1977 | Canada | 162/360.1 |
| WO88/03192 | 5/1988 | World Int. Prop. O. | 162/360.1 |

*Primary Examiner*—W. Gary Jones
*Assistant Examiner*—Todd J. Burns
*Attorney, Agent, or Firm*—Steinberg & Raskin

[57] ABSTRACT

A method is provided for the removal of water from a web by hot-pressing while the web is in direct contact with a heated cylinder face. The web is passed, while being supported by a press fabric, through at least two separate press stages. The web is first passed into direct contact with the heated cylinder face and into an extended-nip press stage. At the beginning the extended-nip press stage, a press-glide belt is passed into contact with the press fabric, the press-glide belt is pressed by means of a press member in the extended-nip stage against the heated cylinder face. This press-glide belt is separated from the fabric and the web is passed to the next stage where the web is pressed against a cylinder face only by means of the tension of the press fabric. After this latter stage, the web is passed to an intensive roll-nip pressing stage, through a roll-nip which is formed between the hot cylinder and a hollow-faced press roll. In this stage, water is removed from the web into the press fabric and into the hollow face of the press roll. The press fabric is separated from the web, which is then detached from the face of the hot cylinder.

12 Claims, 2 Drawing Sheets

HOT-PRESSING METHOD

This is a division of application Ser. No. 495,484, filed Mar. 19, 1990, now U.S. Pat. No. 5,092,962.

BACKGROUND OF THE INVENTION

The invention relates to a method for the removal of water from a paper or board web, by hot-pressing, the hot-pressing taking place when the web is in direct contact with a heated roll or cylinder face. According to the method, the web to be pressed is passed, when supported by a pressed fabric, through at least two separate press stages.

The most common prior art method of dewatering of fibrous webs, in particular, paper and board webs, is to pass the web through a press nip formed by two rolls placed one opposite the other. As is well known, one or two press fabrics are used in the dewatering nips, and these carry the water removed from the web further and act as a fabric carrying the web forward.

With increasing production rates of paper machines, the dewatering performed as nip pressing has become a bottle neck that limits the increase in the running speeds, because the press nips formed by a pair of rolls have a short area, so that with high speeds, the time or dwell of the web in these press nips remains short.

Attempts can be made to extend the compression area in roll-nips by using rolls of larger diameter and soft press fabrics. However, even with these means, the limit of an economically satisfactory embodiment is soon reached. As a result of these problems, and for other reasons, so-called extended-nip presses have been inverted in recent years. Reference may be made in this respect by of example to U.S. Pat. Nos. 3,783,097; 3,808,092; 3,840,429; 3,970,515; 4,201,624; and 4,229,253, as well as Finnish U.S. Pat. Nos. 65,104; 70,952; and 71,369.

Extended-nip presses are known in the prior art wherein the press area is formed between a revolving hose mantle, provided with a stationary core and a counter-roll. In the stationary roll core, hydraulically loaded pressure shoes are utilized by means of which, with the intermediate of the revolving mantle, a compression pressure is applied to the web towards the counter-roll. The counter-roll may be either an ordinary press roll or a roll provided with a hydraulic glide shoe. As examples of the prior art extended-nip press of the type described above, reference is made to British Patent Application No., 2,057,027, to be published as Patent Application WO 82/02567, and to Finnish Patent No. 66,932. So called hot-pressing methods are also known in the prior art, and reference is made by way of example to U.S. Pat. No. 4,324,613, and to U.S. patent application Ser. No. 07/184,249, filed on Apr. 22, 1988, now U.S. Pat. No. 4,976,820 commonly assigned).

SUMMARY OF THE INVENTION

As indicated above, the invention relates to a method for the removal of water from a paper or board web by hot-pressing, the hot-pressing taking place when the web is in direct contact with a heated roll or a cylinder face. The web to be pressed is passed, supported by a press fabric, through at least two separate press stages.

The invention further relates to a hot-pressing device intended for carrying out the method of the invention, the device comprising a hot cylinder, or an equivalent roll, and heating means by which the smooth outside face of the hot cylinder is heated. The device comprises a press felt guided by rolls and at least two press members, which form press zones together with the hot cylinder, and through which press zones, the press fabric and the web to be pressed, supported by the fabric, are passed so that the web reaches direct contact with the heated face of the hot cylinder.

It is an object of the present invention to provide modifications and improvements in the methods and devices for hot-pressing which are described in Finnish Patent Application Nos. 871870 and 880700, which describe a hot-pressing method and device in which a hot cylinder is employed against which an extended-nip press shoe acts followed by a press roll. An impervious, as a rule metallic, press-glide belt, which generally is provided with an external hollow face, is passed over the extended nip shoe and press roll. When a press belt arranged in this way is employed, problems may occur in the control of splashes of lubricant. An additional problem which may occur is that in the form of the hollow face in the press belt, or in some other way, in the intensive nip pressing stage, space must be provided for the water that is being drained out of the web.

It is accordingly a primary object of the present invention to provide a hot-pressing method in which a particular hollow face, e.g. grooved belt is not required. Instead, the draining of water in the high load roll-nip according to the invention can be arranged by conventional means which have been tested and found to be satisfactory.

Other objects and advantages of the present invention will be apparent from a further reading of the specification and of the appended claims.

In accordance with the method of the present invention, the following stages are carried out in the sequence set forth:

the web is passed on a support of the press fabric into direct contact with a heated cylinder face and to an extended-nip press stage, either slightly before or at the start of the extended nip press stage, a press-glide belt is passed into contact with the press fabric, the press-glide belt is pressed by means of a press member or members in the extended-nip press stage against the heated cylinder face, the press-glide belt is separated from the press fabric, and the web is passed to the next stage, wherein the web is pressed against the cylinder face, substantially only by means of the tensioning pressure of the tension of the press fabric, after this latter stage, the web is passed into an intensive roll-nip press nip pressing stage through a roll nip which is formed between the hot cylinder and a hollow faced press roll fitted inside the loop of the press fabric, in this latter stage, water is removed from the web into the press fabric and into the hollow face of the press roll, and the press fabric is separated from the web which is then detached from the face of the face of the hot cylinder.

The objects of the present invention are accomplished by means of a device which comprises a belt roll provided with a hose-like press-glide belt mantle provided with a press member or members inside the mantle, the press member or members forming a pressure loaded extended-nip against the hot cylinder, the belt roll and its press-glide belt mantle being arranged in such way that the press-glide belt enters into the extended nip substantially at its beginning and departs from it at the end of the extended nip or slightly thereafter, and a hollow faced press roll is arranged in connection with the hot cylinder to form a roll-nip with the hot cylinder.

The extended nip press loading produced by means of the roll provided with a hose like mantle, results mainly in intensification of the transfer of heat taking place from the hot cylinder to the web, this being the primary aim rather than dewatering being the primary aim. The value of linear load employed in the extended-nip is preferably at least 150 kN/m, which at the present time is considered an ordinary load in a roll press. However, this value is only a guide value and it can be increased or reduced for the purpose of providing adequate heat transfer. By means of hose rolls, loads of even about 100 kN/m have been achieved within the normal temperature range.

The sharp second nip employed in accordance with the present invention is an ordinary roll-nip, wherein a grooved roll or some other hollow-faced roll is used. The linear load in this nip is most preferably on the order of 150 kN/m, or, if necessary, greater. Comparing the present invention with the hot-pressing methods and devices described in the Finnish Patent Applications 871871 and 880700, it is noticed that in the second nip, the dewatering takes place by means of conventional roll pressing technique, and in accordance with the invention, no particular grooved belt is needed because the dewatering space can be arranged in the conventional hollow-faced press roll. In the invention, in the area between the nips, the felt tensioning pressure $P = T/R$ (R is the radius of the hot cylinder, T is felt tension), presses the paper web with a low force against the hot cylinder. The length of and the compression pressure in the zone are not at all critical in connection with the present invention.

In the method and device of the invention, in the first two press zones, (extended nip) heating of the web to be pressed takes place preferably within a range of about 90°-100° C., without vaporization of water as yet. It is for this reason that the temperature of the face of the hot cylinder, or of an equivalent roll, may advantageously be within a range of 90°-150° C., i.e. in the same temperature range that can be applied in the drying cylinders currently in use.

BRIEF DESCRIPTION OF THE DRAWINGS

The invention will be described in greater detail below with reference to some exemplifying embodiments as shown in the figures in the accompanying drawings. It is to be understood that the invention is not limited to the details of these embodiments, in which.

DESCRIPTION OF PREFERRED EMBODIMENTS

The hot-pressing device of the invention comprises a heated roll or cylinder 10 having a relatively large diameter and a smooth outer face 10'. The cylinder 10 is provided with a drive **10*a* and with a doctor 10k. The face of the cylinder 10** or roll is heated internally and/or externally by means of steam, flame heating, various radiations, such as infrared radiation, or high frequency heating, and/or by means of induction heating devices based on eddy currents.

Figure 1:
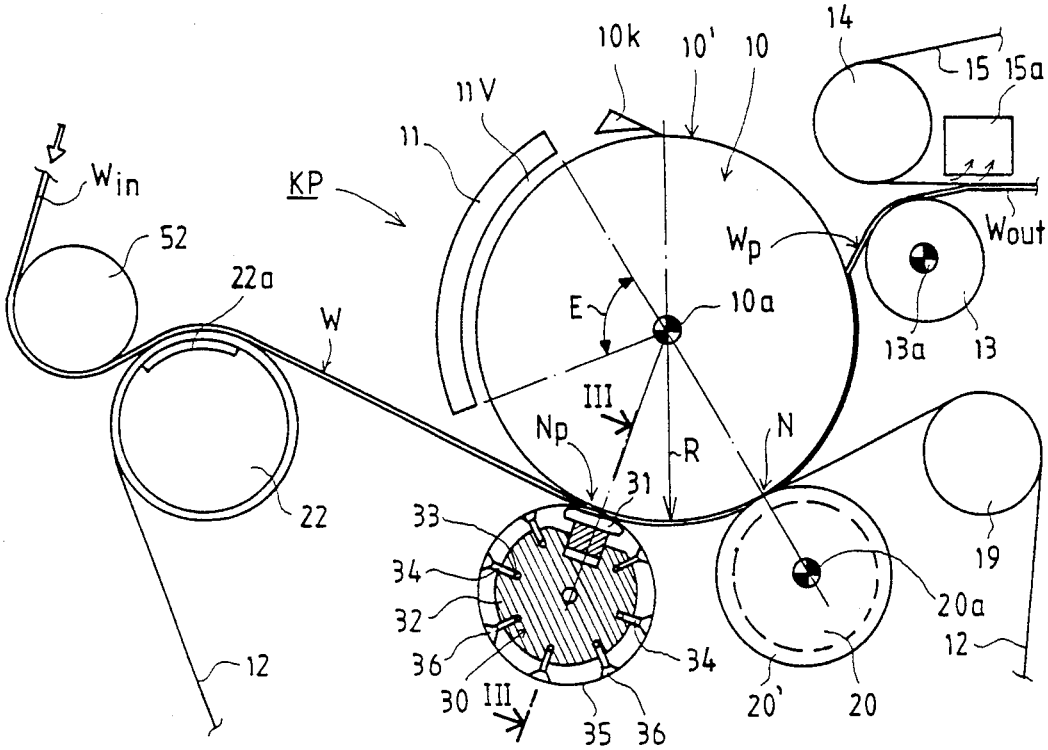
FIG. 1 is a schematic sectional view of a hot-pressing device in accordance with the invention.

FIG. 1 includes a schematic illustration of an induction heating device, flame heating device or infrared heating device 11, which heats the face 10' of cylinder 10 externally, free of contact, through an air gap 11V within a sector E, the magnitude of which is most appropriately about 90° or greater. The device may also include steam supply means by which pressurized steam can be passed through a steam coupling (not shown) placed at the end at the cylinder 10, into the cylinder 10, through steam pipes, e.g. by means of the same principle as applied in the drying cylinders in the drying section, which are per se known.

The temperature $T_o$ of the face 10' of the cylinder 10 is arranged most appropriately at the level $T_0 = 90°-150°$ C. when the face 10' meets the web W which is being introduced onto the face of the press felt 12 into the hot-pressing.

Figure 2:
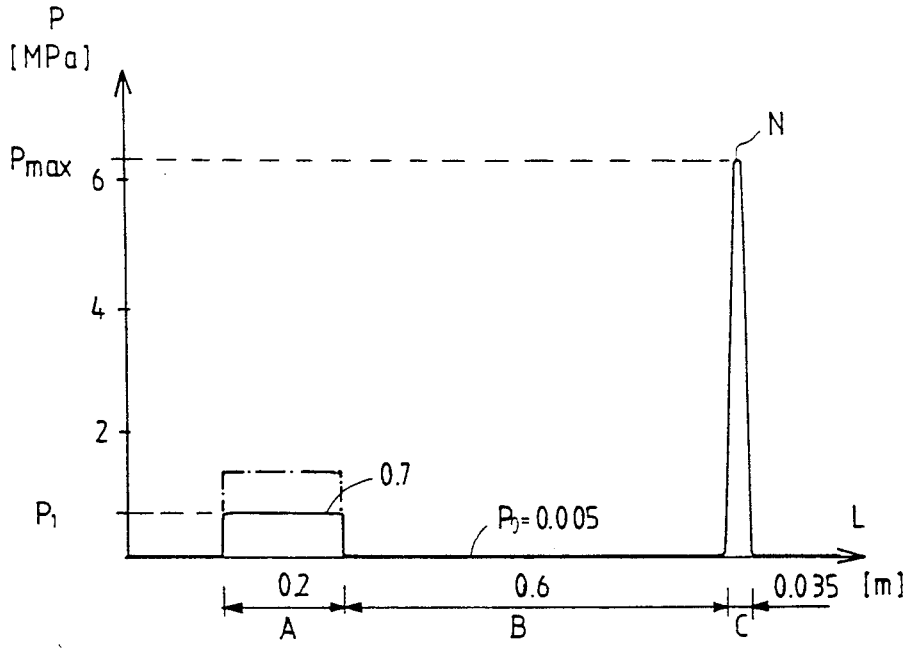
FIG. 2 illustrates the distribution of compression pressure P carried into effect in the device shown in FIG. 1 over the length L of the various press zones.

As is shown in FIG. 1, the board or paper web $W_{in}$, whose dry solids content, as a rule, within the range of 20-45%, is introduced over the paper guide roll 52, onto the press felt 12, to which it is made to adhere by means of the negative pressure of the suction zone **22*a*, of the suction roll 22. The web W is then passed into the extended-nip $N_p$ which has a relatively wide press zone A (FIG. 2). The extended nip $N_p$ is formed between the hot cylinder 10 and the hose roll 30, which is provided with a flexible mantle 35, and which acts as the lower roll in the extended nip $N_p$. In the extended nip $N_p$, heating of the web W takes place to about 90°-100° C., but vaporization of water does not necessarily take place. It is for this reason that the temperature of the hot cylinder 10** does not have to exceed about 90°-150° C., i.e. approximately the same as with the prior art drying cylinders. The primary aim of the load in the extended nip $N_p$, is to improve heat transfer and not so much dewatering of the web W.

As shown in FIG. 2, the compression pressure $P_1$, used in the extended nip $N_p$, is most appropriately about 0.5-1.5 MPa. After the extended nip $N_p$, the web W enters sector B, the length of which is, for example, about 500-700 mm (in FIG. 2, B = 600 mm). In the zone B, a compression pressure $P_o = T/R$ (R is the radius of cylinder 10) prevails, which is based on the tension T of the press felt 12 and wherein the compression pressure $P_o$ is on the order of approximately 5 kPa.

After the zone B, between the rolls 30 and 20, the web W is passed into the roll-nip N, which is formed between the hot cylinder 10 and an ordinary press roll 20 provided with a hollow face 20'. In a manner per se known, the hollow face 20' may be a grooved face, a blind-drilled face or the equivalent. The press roll 20 is preferably provided with a drive **20*a* and if necessary, it may also be a variable-crown or adjustable-crown roll. In the press nip N, the hollow face 20' acts as a space that receives water, together with the structure of the felt 12. The roll-nip N is quite sharp, and the length C of this zone, is a rule, with the range of C = 30-50 mm. In FIG. 2, zone C = 35 mm. The maximum compression pressure $P_{max}$ prevailing in the nip N is on the order of 6-7 MPa (in FIG. 2, $P_{max}$ = 6.5 MPa), which corresponds to a range of linear load of 135-155 kN/m After the nip N, the web W separates from the press felt 12, which is guided from by the guide roll 19 and which is passed to reconditioning. Thereupon, the web W follows the smooth face 10' of the cylinder 10, from which it is detached as the draw $W_p$, by means of a guide roll 13 provided with a drive 13***a*, transferred onto the support of the drying fabric 15, guided by the guide roll 14, aided by the suction box 15*a*, the fabric 15 carrying the web W into the drying section, where the removal of water is continued by evaporation.

It is an important feature of the invention that in the formulation of the extended nip $N_p$, a particular hose roll 30 is used which is provided with a flexible belt mantle 35. The hose roll 30 is provided with a stationary roll core 32, or with an equivalent frame beam. The roll core 32 is supported on supports 56 by means of its axial journals 55 (FIG. 3), and by the intermediate of a ring 57 which has a spherical face. The supports 56 are attached to the frame parts or foundations of the press by the intermediate of trestles or the equivalent. A thin walled mantle 35, which is pressed from inside by a hydraulically loaded shoe 31, in the area of the extended press zone A formed with the cylinder 20, revolves around the stationary core 32.

The roll core 32 comprises a number of radial grooves in which there are ribs 34 loaded by springs 33 Glide shoes 36 are supported on the ribs 34 by the intermediate of bearing rolls, the glide shoes 36 gliding and supporting the revolving mantle 35. The glide shoes 36 and the press shoe 31 require lubrication, and for this purpose lubricant is fed from several different points, (not shown) onto the inner face of the mantle face 35, and/or onto the glide faces of the glide shoes 36 and of the press shoe 31. The press shoe 31 is loaded by a number of hydraulic cylinders placed side by side, or by a corresponding rib-like piston or pistons by the intermediate of a bearing roll or rolls. The rib-like piston or pistons, is/are loaded by means of hydraulic fluid which is introduced through ducts into the roll core 32 from sources of pressure medium (not shown) which in themselves are known. By means of regulation of the pressure of the pressure fluid, it is possible to alter the compression pressure in the extended nip $N_p$.

As is seen from FIG. 1, the roll mantle 35 must change its shape considerably from the circular shape in the area of the press shoe 31, and of the press zone A. It is not necessary that the roll mantle 35 be expressly of circular shape when guided by the shoes 36 outside the area of the press zone A. In some cases, an elliptical form, a crawler form, or a continuous "heart-shaped" form of the mantle 35 may be preferred. The construction of the ends of the mantle 35 submit the use of a cross sectional form of the mantle 3 which can vary within very wide limits.

Figure 3:
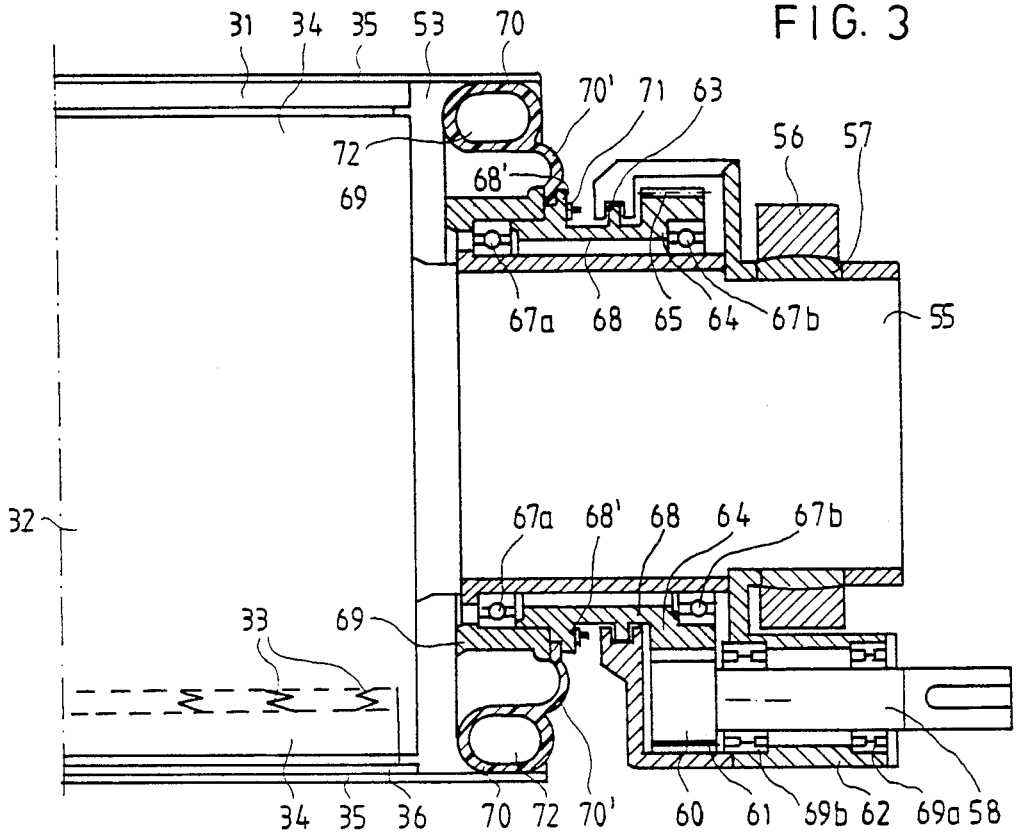
FIG. 3 is a sectional view taken at III—III in FIG. 1.

As shown in FIG. 3, a bushing part 68 is mounted by means of bearings 67*a* and 67*b* around each axial journal 35 of the roll core 32. The outer end of the bushing part is provided with a cogwheel 64 provided with a toothed rim 65. The cogwheel 64 is driven by a cogwheel 60, which is mounted at the end of a shaft 58 and which is provided with a toothed rim 61. The shaft 58 is mounted on bearings 69*a* and 69*b*, placed at a distance from one another. These bearings are fitted in part 62, which is supported as stationary on the supports 56 of the axial journals 55. Between the part 62 and the revolving part 68, there is sealed grooved-projection fitting 63 which permits rotation.

An elastic seal ring 70 is fixed by the intermediate of its edge flange 70', between the fastening ring 69 and the projection part 68' of the revolving part 68. The edge of the flange 70' is attached into the groove between the parts 68' and 69 by means of a screw fastening 71. In the interior 72 of the elastic seal ring 70, by means of a valve (not shown), an appropriate air pressure is arranged which presses the seal ring 70 against the inner face of the mantle 35. The shaft 58 rotates the seal ring 7 by the intermediate of the part 68 synchronously with the operation of the roll 10.

Owing to its elasticity, the seal ring 70 permits deformations of the mantle 35 during each revolution so that, in spite of these deformations, the sealing remains adequate and fluid cannot enter out of the space 53 between the mantle 35 and the roll core 32, into places to which it should not have access. By regulation of the pressure in the interior 72 of the seal ring 70, it is possible to appropriately vary the elasticity of the seal ring 70. The outer parts of the seal ring 70 are preferably made, e.g. of rubber without reinforcements, whereas in the inner parts of the ring 70, and in the fastening flange 71, it is possible to use reinforcement fabrics, if necessary such fabrics being impregnated, for example, into the rubber material. The sealed ring 70, resembles, for example, the air-tight tubes of vehicle tires, with the exception of the fastening flange 70.

In this connection, it should be emphasized that the above description with reference to FIG. 3, exemplifies only one embodiment of a hose roll. However, it is possible within the scope of the invention to use several different hose roll constructions, e.g. constructions that are described in Finnish Patent No. 66,932, or in Finnish Patent Application No. 891380, filed Mar. 22, 1989, (corresponding to U.S. patent application Ser. No. 486,754, filed Mar. 1, 1990). For the purposes of the present invention, it is an important feature of the construction of the hose roll that, in one way or another, splashes of lubricant necessary for lubrication of the pressure 31 and the glide belt 35 and the possible other guide members 34 in the hose roll onto the press belt 12 and to the web W are prevented.

As set forth above, at least partly, the press-glide belt 35, of the hose roll 30 is not passed into contact with the face, preferably the lower face of, the press fabric 12 until at or near the beginning of the extended nip $N_p$, and, in a corresponding way, the press-glide belt 35 is detached from the press fabric 12 at or near the end of the extended nip pressing stage A, and as a consequence, the press-glide belt 35, has not been passed, e.g. over the rolls 22 and 20.

Figure 4:
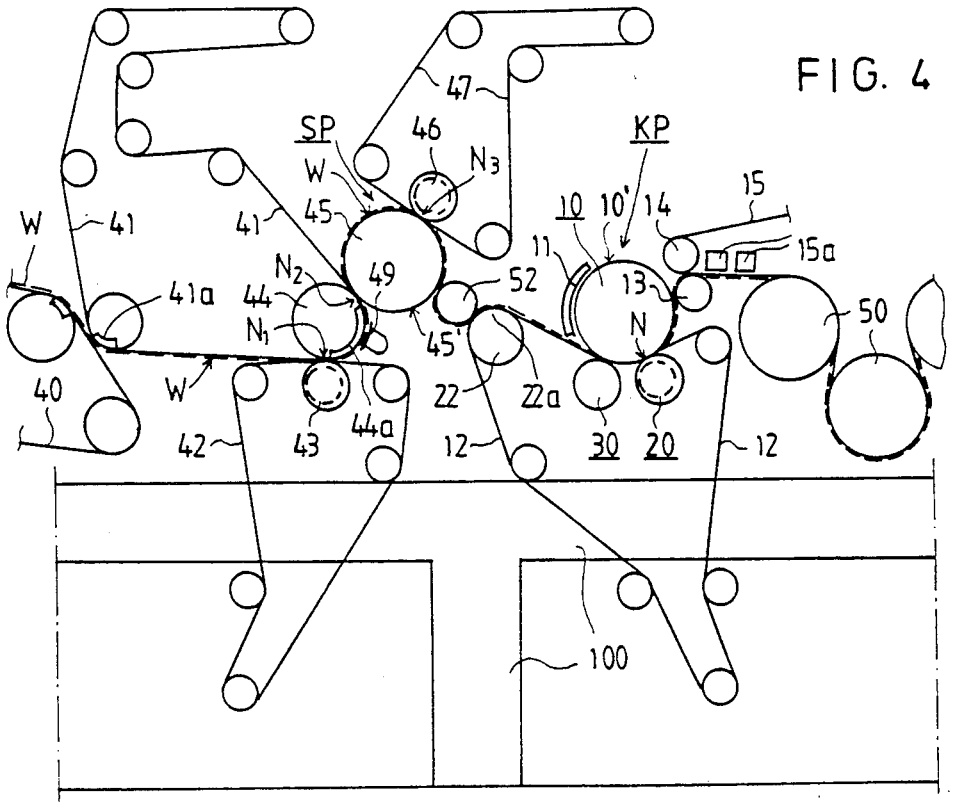
FIG. 4 shows an embodiment of the invention with the location of a press in accordance with the invention after a prior art closed roll press.

FIG. 4. illustrates an advantageous mode of application of the invention in combination with the SYMPRESS II (Trademark) press section SP. The web W is formed on the forming wire 40, transferred onto the felt 41, at the suction zone 41*a* of the pick-up roll. The web W is transferred further, supported by the felt 41, through the first nip $N_1$ in the closed press section SP, said nip being formed by the press roll 43 and the suction roll 44. The lower press felt 42 runs through the nip $N_1$. In order that the dry solids content and the temperature of the paper web W be as high as possible before the hot pressing devices, it is advantageous to use preheaters for the web W. As shown in FIG. 4, such device may be the heater 49 operating against the suction sector 44*a* of the suction roll 44, such heater being, e.g., a steam box, an infrared heater, or a high frequency heater. The second nip $N_2$ in the press section SP, is formed between the suction roll 44 and the smooth-faced center roll 45. The web W adheres to the smooth face 45' of the center roll 45, and is transferred onto it and into the third nip $N_3$ in the press section SP, which is formed between the center roll 45 and the hollow fased roll 46. The press felt 47 runs through the third nip $N_3$.

As further shown in FIG. 4, the web W is transferred on the paper guide roll 52 onto the suction transfer roll 22. The web W is made to adhere to the press felt 12 on the suction zone 22*a* of the suction transfer roll 22. By means of this support, the web W is passed through the hot pressing method and device KP in accordance with the invention. After the hot pressing device KP, the web is passed, as described above with respect to FIG. 1, into the multi-cylinder dryer, of which the first three drying cylinders 50, the drying wire 15, its guide roll 14 and the suction boxes 15*a* are showing in FIG. 4. In FIG. 4, the frame of the press section is denoted with reference numeral 100.

With respect to the embodiment of FIG. 4, it should be noted further that in the compact roll press SP and in the hot press KP, in accordance with the invention, the opposite faces of the web W come into contact against the smooth roll/cylinder face 45'/10', so that with respect to its surface properties, the web W becomes as symmetric as possible.

Owing to the intensified dewatering, by means of the method of the present invention, which can be carried out in one stage or in several stages, an increased dry solids content at the outlet of the press section is achieved, which can be as high as 50-60%.

It is also possible within the scope of the present invention to use more than one, e.g. two, hot pressing devices KP, one after the other. These devices are not necessarily fitted one after the other, but between the devices, instead of, or in addition to the heating devices mentioned above, there may be conventional steam heater drying cylinders over which the web W to be dried is passed.

While the invention has been described in particular with respect to specific embodiments, it is apparent that variations and modifications of the invention can be made within the scope thereof. Such variations and modifications are intended to be covered by the present invention.

What is claimed is:

1. Method for the removal of water from a paper or board web by hot-pressing taking place when the web is in direct contact with a heated roll or cylinder face, and in which the web to be pressed is passed, supported by a press fabric, through at least two separate press stages, said method comprising the following sequential steps:

passing the web supported by a press fabric into direct contact with a heated cylinder face and into an extended-nip press stage, at the beginning, or slightly before the extended nip press stage, passing a closed mantle comprising a press-glide belt sealed around a press member or members into contact with the press fabric, the press-glide belt being pressed by means of said press member or members in the extended-nip press stage against the heated cylinder face, separating the press-glide belt from the press fabric and passing only the web and the press fabric to a next stage where the web is pressed against said cylinder face substantially only by tensioning pressure of the tension of the press fabric, passing the web supported by the press fabric after the said next stage into an intensive roll-nip press stage through a roll-nip which is formed between the hot cylinder and a hollow faced press roll fitted inside the loop of the press fabric, removing water from the web in said roll-nip stage into the press fabric and into the hollow face of the press roll, separating the press fabric from the web which is then detached from the face of the hot cylinder.

2. Method according to claim 1, wherein heat transfer is intensified between the face of the hot cylinder and the web in said extended nip press stage and a substantial amount of dewatering is effected in a pressing stage after said extended nip press stage.

3. Method according to claim 1, wherein compression pressure in the extended nip press stage is between about 0.5-5.0 MPa.

4. Method according to claim 3, wherein the tensioning pressure resulting from the tension of the press fabric in said next stage is between about 0.003-0.033 MPa.

5. Method according to claim 4, wherein the maximum pressure in said intensive roll-nip press stage is between about 4-20 MPa.

6. Method according to claim 1, wherein compression pressure in the extended nip press stage is between about 0.5-1.5 MPa.

7. Method according to claim 6, wherein the tensioning pressure resulting from the tension of the press fabric in said next stage is between about 0.005-0.015 MPa.

8. Method according to claim 7, wherein the maximum pressure in said intensive roll-nip press stage is between about 6-7 MPa.

9. Method according to claim 1, wherein the web in the extended-nip press stage is heated to a temperature of about 90°-100° C. and the heated cylinder face is at a temperature of about 90°-150° C., before contact with the web.

10. Method according to claim 1, wherein the web is first passed into a press provided with a smooth-faced center roll and is then passed through at least one hot pressing stage wherein the side of the web opposite that which contacts the smooth face of the center roll is contacted with the smooth face of the hot cylinder.

11. Method according to claim 1, wherein said mantle of said press glide belt is hose-like, and wherein in the extended nip press stage, a lower roll is provided which consists of a roll having said hose-like press glide mantle with both ends of the mantle being sealed to prevent fluid splashes.

12. Method according to claim 1, wherein the web is passed over a guide roll detaching said web from the face of the hot cylinder after the intensive roll-nip press stage.

* * * * *